United States Patent [19]

Chambers

[11] 4,279,524

[45] Jul. 21, 1981

[54] APPARATUS FOR ADVANCING A RECORD MEDIUM

[75] Inventor: William I. Chambers, Wichita, Kans.

[73] Assignee: NCR Corporation, Dayton, Ohio

[21] Appl. No.: 76,055

[22] Filed: Sep. 17, 1979

[51] Int. Cl.[3] ..... B41J 19/96

[52] U.S. Cl. ..... 400/564.1; 400/550; 400/571; 400/314.1

[58] Field of Search ..... 400/550, 555, 556, 571, 400/564, 568, 564.1, 314, 314.1

[56] References Cited

U.S. PATENT DOCUMENTS

| | | | |
|---|---|---|---|
| 687,496 | 11/1901 | Corr | 400/564.1 X |
| 965,346 | 7/1910 | Uhlig | 400/556 |
| 1,985,959 | 1/1935 | Stickney | 400/550 X |
| 2,917,153 | 12/1959 | Westaver | 400/314.1 |
| 3,272,303 | 9/1966 | Pohl | 400/550 |
| 3,820,646 | 6/1974 | Lombardi | 400/571 X |
| 3,856,128 | 12/1974 | Taggart | 400/550 |
| 3,960,258 | 6/1976 | Aebi | 400/550 |
| 4,013,159 | 3/1977 | Okabe | 400/571 |

FOREIGN PATENT DOCUMENTS

| | | | |
|---|---|---|---|
| 2428944 | 1/1976 | Fed. Rep. of Germany | 400/556 |

*Primary Examiner*—Edward M. Coven

*Attorney, Agent, or Firm*—J. T. Cavender; Albert L. Sessler, Jr.; Elmer Wargo

[57] ABSTRACT

An apparatus which may be used, for example, for feeding a record medium in a printer. The apparatus includes a rotatable member having means thereon for connection to the platen of the printer, and also having teeth on the periphery thereof and a driving surface thereon. The apparatus also includes a rotatable driving unit having at least one driving member or camming lug thereon to engage the teeth and thereby incrementally rotate the rotatable member as the driving unit is rotated. The apparatus further includes a coupling means moveable between first and second positions whereby the coupling means is operatively disconnected from the driving unit and the rotatable member when the coupling means is in the first position, and whereby the coupling means when in the second position is effective to disconnect the camming lug from the teeth and to also operatively connect the driving unit with the driving surface to continuously rotate the rotatable member as the driving unit is rotated.

12 Claims, 8 Drawing Figures

APPARATUS FOR ADVANCING A RECORD MEDIUM

BACKGROUND OF THE INVENTION

This invention relates to an apparatus for advancing a record medium in a printing machine, and more particularly, it relates to an apparatus of the type described which can be operated in any one of three modes of operation, namely:

1. Manual,
2. Incremental, or
3. Slewing.

In certain printing or typing operations, for example, a platen and pinch rollers are utilized to advance a record medium with regard to the associated print head. As each line of printing is completed, the platen is incrementally rotated to advance the record medium thereon. At certain times, it is desirous to fast-feed or slew the record medium past the print head without any printing taking place. At other times, it is also desirous to be able to manually advance the record medium.

Some of the prior art apparatuses for performing the operations of the types described in the previous paragraph are extremely complex in design and expensive to manufacture.

SUMMARY OF THE INVENTION

This invention relates to an apparatus which may be used, for example, for feeding a record medium in a printer. The apparatus includes a rotatable member having means thereon for connection to an output member and also having engagement surfaces and a driving surface thereon. The apparatus also includes a rotatable driving unit having at least one driving member thereon to engage the engagement surfaces and thereby incrementally rotate the rotatable member as the driving unit is rotated. The apparatus further includes a coupling means moveable between first and second positions whereby the coupling means is operatively disconnected from the driving unit and the rotatable member when the coupling means is in the first position, and whereby the coupling means when in the second position is effective to disconnect the driving member from the engagement surfaces and to operatively connect the driving unit with the driving surface to continuously rotate the rotatable member as the driving unit is rotated.

DETAILED DESCRIPTION OF THE INVENTION

Figure 1:
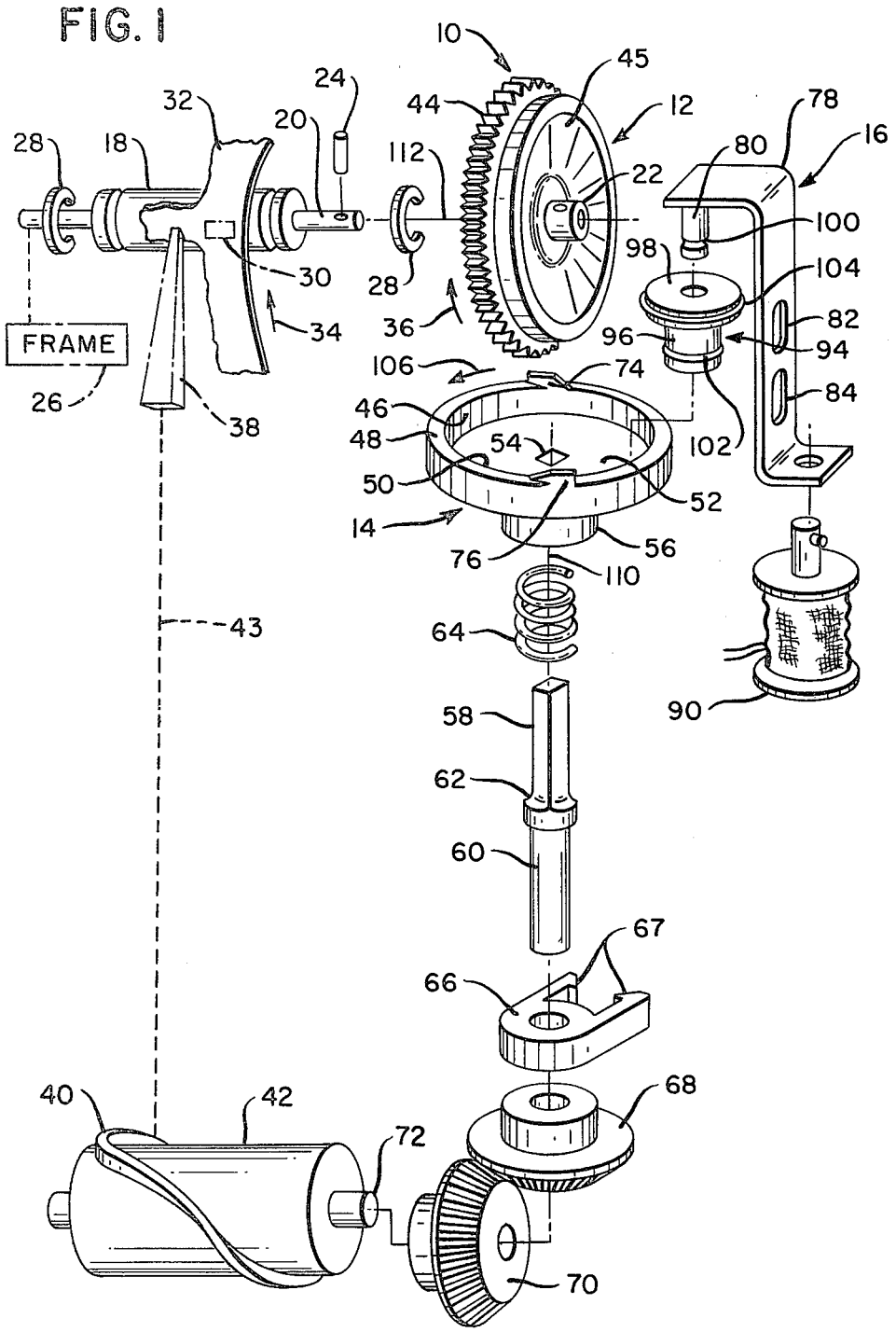
FIG. 1 is a general perspective view, in exploded form, showing a preferred embodiment of this invention, including generally, a rotatable member, a rotatable driving unit and a coupling means.
Figure 3:
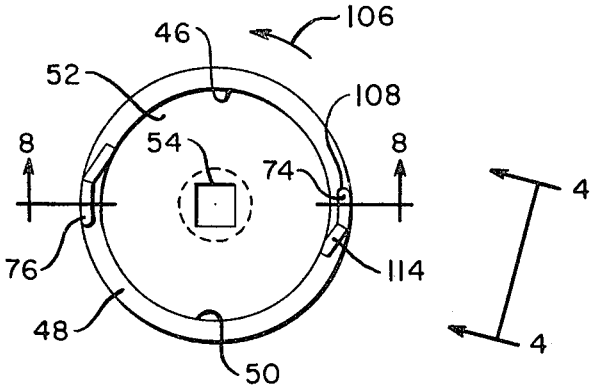
FIG. 3 is a plan view of the portion of the driving unit shown in FIG. 2.
Figure 2:
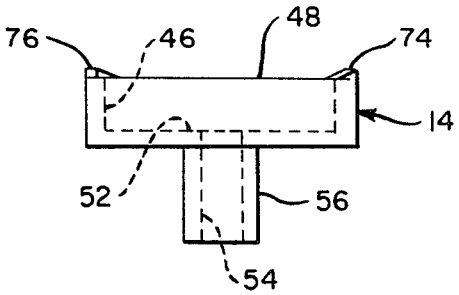
FIG. 2 is a side view of a portion of the rotatable driving unit shown in FIG. 1.
Figure 4:
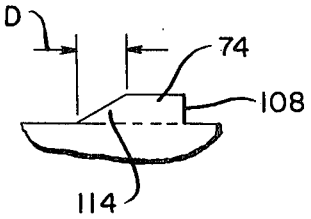
FIG. 4 is an enlarged view taken along the line 4—4 of FIG. 3 showing additional details of a driving member on the driving unit.

FIG. 1 is a general perspective view, in exploded form, of a preferred embodiment of the apparatus of this invention which is designated generally as 10. The apparatus 10 generally includes a thumb wheel or a rotatable member 12, a cam member or a rotatable driving unit 14, and a coupling means 16 which enables the apparatus 10 to be operated in different modes as will be described hereinafter.

The rotatable member 12 (FIG. 1) rotates the platen 18 by having the shaft 20 supporting the platen secured to the hub 22 by a pin 24. The shaft 20 is supported in a conventional frame 26 shown only diagrammatically in FIG. 1. The platen 18 and the rotatable member 12 are rotatably mounted in the frame 26 and restrained from axial movement relative to the frame 26 by suitable "C" washers 28 which may be anchored via the frame 26. Suitable pinch rollers such as 30 are used to resiliently bias a record medium 32 against the platen 18 causing the record medium 32 to be fed in the direction of arrow 34 whenever the rotatable member 12 is rotated in the direction of arrow 36. A print head 38 is conventionally traversed across a line of printing on the record medium 32 by a continuous cam 40 on a barrel cam 42; conventional cam follower linkage shown as dashed line 43 interconnects the barrel cam 42 with the print head 38 for this purpose.

Figure 6:
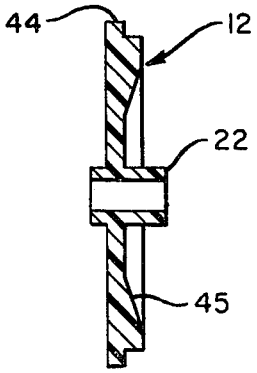
FIG. 6 is a cross-sectional view taken along the line 6—6 of FIG. 5.
Figure 5:
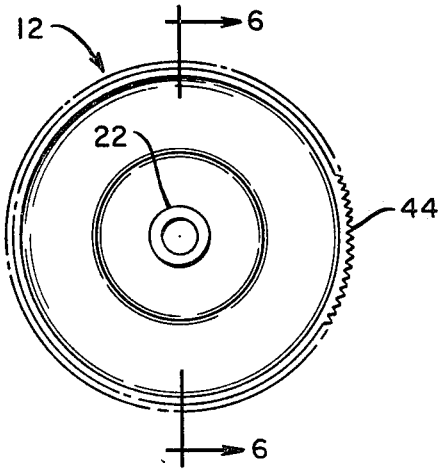
FIG. 5 is a side view of the rotatable member shown in FIG. 1.

The rotatable member 12 (FIGS. 1, 5, 6) has a plurality of engagement surfaces or teeth 44 on the periphery thereof as shown. In the embodiment described, the rotatable member 12 is made of a plastic material such as Delrin which is manufactured by DuPont, and which material may be conventionally formed, as by injection molding, for example. The rotatable member 12 also has a continuous driving surface 45 which is generally conical in shape as is best shown in FIG. 6. In the embodiment described, the surface 45 lies at an angle of 15 degrees with respect to a vertical line in FIG. 6.

The rotatable driving unit 14 (FIGS. 1–4) has an inner cylindrical wall 46 and a top surface 48 forming a circular edge 50 therebetween as is best shown in FIG. 1. The driving unit 14 also has a circular base 52 having a square hole 54 therein. The hole 54 extends through an extension 56 on the unit 14, and the square end 58 of a driving shaft 60 is inserted in the square hole 54 of the driving unit 14 to form a driving connection therebetween. The square end 58 of the shaft 60 has an enlarged area 62 to provide an abutment area for the spring 64 which is positioned between the extension 56 and the enlarged area 62 to resiliently bias the unit 14 into engagement with the rotatable member 12 as will be described later herein. The driving unit 14 is axially movable on the square end 58 of the shaft 60. The shaft 60 is rotatably supported in a bearing 66 and is rotatably driven by any convenient driving member such as a bevel gear 68. The bearing 66 has expandable fingers 67 thereon which engage a conventional mating member (not shown) which is part of the frame 26 to provide a fixed center of rotation for the driving unit 14. In the embodiment described, the bevel gear 68 is driven by an identical second bevel gear 70 which is fixed to the shaft 72 of the barrel cam 42 which in turn is driven by any conventional drive (not shown).

The rotatable driving unit 14 (FIGS. 1–4) has two cam lugs or driving lugs 74 and 76 located on top surface 48 thereof. The function of these lugs 74 and 76 is to coact with the teeth 44 on the rotatable member 12 and thereby incrementally rotate the member 12 as the driving unit 14 is rotated. When the print head 38 is used for bi-directional printing, for example, lugs 74 and 76 are utilized to index the platen 18 to present a new line on the record medium 32 for printing each time the print head 38 reaches a limit of travel in opposed directions along the platen 18. The operation of the lugs 74 and 76 will be described in detail hereinafter.

Figure 7:
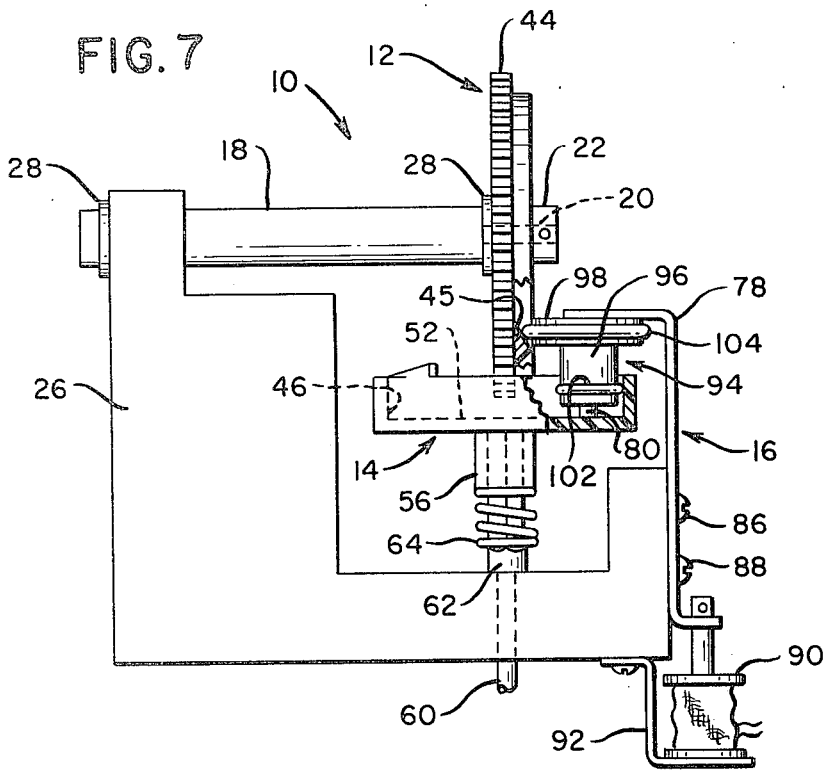
FIG. 7 is an assembled view, in elevation and partly in cross section, of a portion of the elements included in FIG. 1.

The coupling means 16 alluded to earlier herein (FIGS. 1 and 7) includes an "S"-shaped lever 78 with one end of a rod 80 fixed thereto as shown. The lever 78 has two elongated slots 82 and 84 therein through which screws 86 and 88 pass to slidably retain the lever 78 to the frame 26 as shown in FIG. 7. A solenoid 90, secured to the frame 26 by a bracket 92, is used to pull the lever 78 downwardly as viewed in FIGS. 1 and 7 when the solenoid is energized.

The coupling means 16 (FIGS. 1 and 7) also includes a coupling member 94 having a first cylindrical portion 96 and a second cylindrical portion 98 which have a common axis of rotation. The cylindrical portions 98 and 96 have diameters of approximately one inch and $\frac{3}{8}$ inch, respectively, in the embodiment described. The coupling member 94 is rotatably mounted on the rod 80 and retained thereon by a "C" washer (not shown) which is inserted in the annular groove 100. The coupling member 94 has an "O" ring 102 located in a matching annular recess (not shown) on the first cylindrical portion 96 and a second "O" ring 104 similarly mounted on the second cylindrical portion 98.

Figure 8:
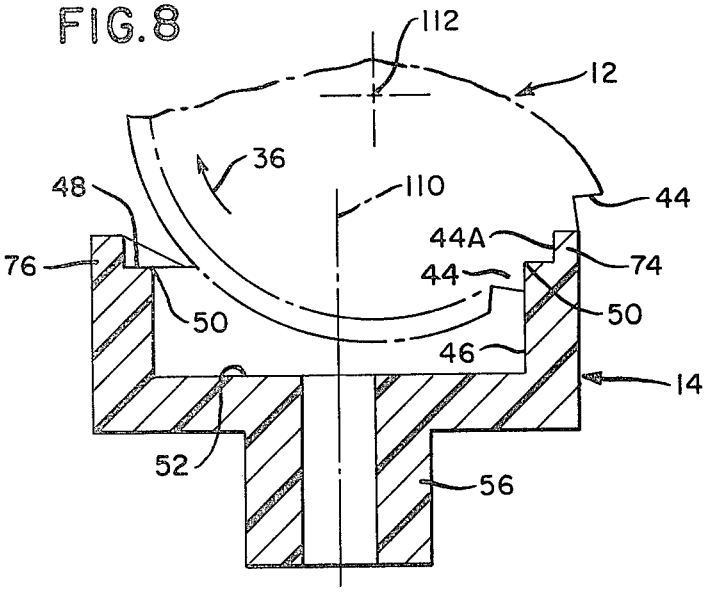
FIG. 8 is a cross-sectional view of the driving unit which view is taken along line 8—8 of FIG. 3 to show its relationship to a portion of the rotatable member; the elements shown herein are exaggerated in size to facilitate a showing thereof.

Earlier herein it was stated that the apparatus 10 can be operated in three different modes. In the first or manual mode, the driving unit 14 generally is not being rotated; consequently, the rotatable member 12 simply can be rotated manually. The circular edge 50 of the driving unit 14 engages adjacent ones of the teeth 44 as shown in FIG. 8 to normally restrain the rotatable member 12 from rotating. When the rotatable member 12 is manually rotated, the driving unit 14 is pushed downwardly thereby (as viewed in FIG. 8) against the bias of the spring 64, and the circular edge 50 returns to the position shown in FIG. 8 to engage the next succeeding adjacent teeth 44 to operate in detenting fashion.

When the apparatus 10 is operated in the incremental mode mentioned earlier herein, the driving unit 14 is rotated in timed relationship with the print head 38 (FIG. 1) so that when the print head 38 reaches a limit of travel in one direction, one of the lugs 74 or 76 engages a tooth 44 on the rotatable member 12 as will be later described herein. When the apparatus 10 is operated in the incremental mode, the coupling means 16 is in a first position in which the coupling member 94 is positioned closer to the hub 22 than is shown in FIG. 7 and in which the "O" ring 104 is out of engagement with the driving surface 45.

As the driving unit 14 is rotated in the direction of arrow 106 (FIGS. 1, 3) the leading edge 108 (which is chamfered) encounters a tooth face marked 44A in FIG. 8. As seen in FIG. 8, the rotational axis 110 of the driving unit 14 is offset slightly from an imaginary plane including the rotating axis 112 of the rotatable member 12 to enable only one lug 74 or 76 to engage the rotatable member 12 at any one time. As the driving unit 14 rotates, a portion 114 (having the profile shown in FIG. 4) of the driving lug 74, which portion 114 is offset at an angle toward the axis of rotation 110 of the unit 14, engages the face 44A (FIG. 8) and shifts it toward the axis 110, causing the rotatable member 12 to rotate in the direction of arrow 36 (FIGS. 1, 8). As the rotatable member 12 begins to rotate, the driving unit 14 is pushed downwardly (as viewed in FIG. 1) against the bias of spring 64. When the offset portion 114 clears a tooth 44, the rotatable member 12 will have been rotated or incremented one tooth position and the circular edge 50 of the driving unit 14 will rise to again engage the next successive ones of the teeth 44 to thereby restrain the rotatable member 12 from rotation until the next driving lug 76 encounters the next tooth 44 on the rotatable member 12. The offset portion 114 of driving lug 74 as measured at D in FIG. 4 has a length of about 0.25 inch in the embodiment described and the width of the teeth 44 on the rotatable member 12 is about 0.12 inch. The height of each of the driving lugs 74 and 76 as viewed in FIG. 8 is equal to the length of a side of a tooth 44. The included angle at the apex of each tooth 44 is ninety degrees, and in the embodiment described, the outer diameter of the rotatable member 12 is about 2.3 inches with 94 teeth being formed on the periphery thereof. The outer diameter of the driving unit 14 shown in FIG. 8 is approximately 1.78 inches as measured along the associated section line 8—8 shown in FIG. 3.

When the apparatus 10 is to be operated in the slewing mode, it is necessary that the solenoid 90 be energized to pull the lever 78 downwardly (as viewed in FIG. 7) to move the coupling means 16 to the second position shown therein. As the coupling means 16 is moved from the first position to the second position (shown in FIG. 7), the free end of rod 80 engages the base 52 of the driving unit 14 causing it to be moved downwardly against the bias of spring 64, thereby preventing the driving lugs 74 and 76 from engaging the rotatable member 12 as the driving unit 14 is rotated. As the coupling member 94 moves downwardly as viewed in FIG. 7, the "O" ring 104 thereon engages the driving surface 45 on the rotatable member 12, and because the "O" ring 102 is in driving contact with the inner cylindrical wall 46 of the driving unit 14, a driving connection is effected between the driving unit 14 and the rotatable member 12 causing it to rotate in the direction of arrow 36 (FIG. 1) at a fast and continuous rate or expressed differently it means to slew the record medium 32. When it is desired to end the slewing of the record medium 32, the solenoid 90 is de-energized, permitting the spring 64 (FIG. 1) to move the coupling means 16 to the first position in which the "O" ring 104 is out of contact with the driving surface 45 on the rotatable member 12. The driving unit 14 may be rotated in either direction; however, it is preferable to rotate it in the direction of arrow 106 (FIG. 1) for more positive driving of the rotatable member 12.

What is claimed is:

1. An apparatus comprising:

a rotatable member having means thereon for connection to an output member and also having a periphery thereon;

said rotatable member also having teeth on said periphery and also having a driving surface thereon;

a rotatable driving unit having a periphery and also having means for rotating said driving unit;

said rotatable driving unit having at least one driving member extending over a portion of the periphery of said driving unit to momentarily engage said teeth during each rotation of said rotatable driving unit and thereby incrementally rotate said rotatable member as said driving unit is rotated by said rotating means; and a coupling means moveable between first and second positions whereby said coupling means is operatively disconnected from said driving unit and said rotatable member when in said first position and whereby said coupling means when in said second position is effective to disconnect said driving member from said teeth and to operatively connect said driving unit with said driving surface to continuously rotate said rotatable member as said driving unit is rotated.

2. The apparatus as claimed in claim 1 in which said driving unit has first and second surfaces forming a circular edge to coact with said teeth to restrain said rotatable member from rotation except when incrementally rotated by said driving member.

3. The apparatus as claimed in claim 2 in which said rotating means includes a driving shaft to enable said driving unit to be moved axially thereon and in which said driving unit also has a member for resiliently urging said driving unit axially along said driving shaft towards said rotatable member so as to resiliently move said circular edge into contact with said teeth said rotatable member being capable of being manually rotated in a determining manner while said driving unit is not rotated.

4. The apparatus as claimed in claim 3 in which said first surface of said driving unit is an inner cylindrical wall and said coupling means includes a coupling member having first and second peripheral driving surfaces thereon whereby said first peripheral driving surface is in driving engagement with said driving surface of said rotatable member and said second peripheral driving surface is in driving engagement with said inner cylindrical wall when said coupling means is in said second position.

5. The apparatus as claimed in claim 4 in which said coupling means includes a support means having a rod secured thereto with said coupling member being rotatably supported on said rod and said coupling means further includes an actuator operatively connected to said support means for moving said coupling means from said first position to said second position.

6. The apparatus as claimed in claim 4 in which said driving surface on said rotatable member is a conical surface.

7. The apparatus as claimed in claim 1 in which said rotatable member and said rotatable driving unit each have an axis of rotation, with the axis of rotation of said driving unit being perpendicular to the axis of rotation of said rotatable member but offset therefrom.

8. The apparatus as claimed in claim 7 in which said first surface of said driving unit is an inner cylindrical wall and said second surface is a flat surface which are joined to produce said circular edge, and said driving unit also has a spring to resiliently urge said circular edge into engagement with said teeth to resiliently restrain said rotatable member against rotation as said driving unit is rotated; said driving member being located on said flat surface to incrementally rotate said rotatable member when said driving member engages said teeth as said driving unit is rotated by said rotating means.

9. The apparatus as claimed in claim 8 in which said driving unit has a base portion having a driving opening therein and said rotating means further includes a driving shaft having an end which is complementary in shape to said driving opening to rotate said driving unit and to enable it to be axially moved relative to said driving shaft against the bias of said spring.

10. An apparatus comprising:

a platen and a thumb wheel fixed thereto to rotate said platen;

said thumb wheel having teeth on the periphery thereof and also having a driving surface thereon;

a cam member having a bottom, an inside cylindrical wall and a first surface which join each other to form a circular edge;

means for rotating said cam member;

a spring for resiliently urging said circular edge into engagement with the teeth on said thumb wheel to resiliently restrain said thumb wheel from rotation as said cam member is rotated;

said cam member also having at least one cam lug on said first surface to engage the teeth on said thumb wheel to incrementally rotate said thumb wheel as said cam member is rotated, whereby upon continued rotation of said cam member, said cam lug will be disengaged from said teeth, permitting said spring to resiliently urge said circular edge into engagement with the teeth on said thumb wheel to restrain said thumb wheel from rotation;

a coupling member rotatably mounted on a support member for movement between first and second positions; said coupling member having first and second driving surfaces thereon and an end; said coupling member when in said first position being out of driving engagement between said thumb wheel and said cam member; and means for moving said coupling member to said second position whereby said end engages said bottom to disengage said cam member from said thumb wheel and whereby said first driving surface engages said driving surface on said thumb wheel and said second driving surface engages said inside cylindrical wall of said cam member to enable said coupling member to rotate said thumb wheel as said cam member is rotated.

11. The apparatus as claimed in claim 10 in which said thumb wheel and platen have a common axis of rotation, and said cam member has an axis of rotation which is perpendicular to said common axis, but is offset laterally therefrom, and said driving surface is conical in shape.

12. The apparatus as claimed in claim 11 in which the inside cylindrical wall has a longitudinal axis which is coincident with the axis of rotation of the cam member and said first surface lies in a plane which is perpendicular to said longitudinal axis.

* * * * *